US006210239B1

(12) United States Patent
Harting et al.

(10) Patent No.: US 6,210,239 B1
(45) Date of Patent: Apr. 3, 2001

(54) CONTACT ELEMENT WITH A SCREW-TYPE TERMINAL

(75) Inventors: Dietmar Harting; Albert Ferderer, both of Espelkamp (DE)

(73) Assignee: Harting KGaA (DE)

( * ) Notice: Subject to any disclaimer, the term of this patent is extended or adjusted under 35 U.S.C. 154(b) by 0 days.

(21) Appl. No.: 09/241,456

(22) Filed: Feb. 2, 1999

(30) Foreign Application Priority Data

Feb. 6, 1998 (DE) ..... 198 04 702

(51) Int. Cl.[7] ..... H01R 4/36
(52) U.S. Cl. ..... 439/814
(58) Field of Search ..... 439/811, 814, 439/815, 733.1

(56) References Cited

U.S. PATENT DOCUMENTS

| | | | | |
|---|---|---|---|---|
| 2,015,144 | | 9/1935 | Hoover . | |
| 2,980,881 | * | 4/1961 | McKee | 439/682 |
| 3,550,067 | * | 12/1970 | Hansen | 439/682 |
| 3,579,178 | * | 5/1971 | Travis | 439/733.1 |
| 3,754,203 | * | 8/1973 | Pauza et al. | 439/733.1 |
| 5,314,360 | | 5/1994 | Jang . | |

FOREIGN PATENT DOCUMENTS

| | | | | |
|---|---|---|---|---|
| 393 574 | | 4/1991 | (AT) . | |
| 1 801 261 U | | 12/1959 | (DE) . | |
| 26 44 867 A1 | | 6/1978 | (DE) . | |
| 80 25 820 U | | 2/1981 | (DE) . | |
| 36 26 239 A1 | | 2/1988 | (DE) . | |
| 2414656 | * | 9/1979 | (FR) | 439/814 |
| 708468 | * | 5/1954 | (GB) | 439/811 |
| 1 371 829 | | 6/1972 | (GB) . | |
| 2037495 | * | 7/1980 | (GB) | 439/814 |
| 16-3 620 | | 3/1941 | (JP) . | |
| 53-139 574 | | 11/1978 | (JP) . | |
| 58-21 084 | | 5/1983 | (JP) . | |
| 62-20 265 | | 1/1987 | (JP) . | |
| 7-169 523 | | 4/1995 | (JP) . | |

* cited by examiner

*Primary Examiner*—Gary F. Paumen
(74) *Attorney, Agent, or Firm*—Cook, Alex, McFarron, Manzo, Cummings & Mehler, Ltd.

(57) ABSTRACT

For a contact element with a screw-type terminal for electric conductors, wherein the contact element comprises a conductor connection part provided with a bore, into which the conductor is insertable and clampable by means of a screw insertable at right angles to the bore and/or conductor into a threaded bore in the conductor connection part, and wherein between the end of the screw directed towards the conductor and the conductor a wire protection plate is provided in the bore, it is proposed to make the wire protection plate substantially L-shaped, an angled foot thereby being formed, to insert the wire protection plate into the bore in such a way that the foot is situated at the base of the bore, and to provide the foot with lateral, barb-like mouldings which, upon insertion of the wire protection plate, dig into the wall of the bore.

3 Claims, 4 Drawing Sheets

CONTACT ELEMENT WITH A SCREW-TYPE TERMINAL

THE FIELD OF THE INVENTION

The invention relates to a contact element with a screw-type terminal for electric conductors, wherein the contact element comprises a conductor connection part provided with a bore, into which the conductor is insertable and clampable by means of a screw insertable at right angles to the bore and/or conductor into a threaded bore in the conductor connection part, and wherein between the end of the screw directed towards the conductor and the conductor a wire protection plate is provided in the bore.

With such screw-type terminals, it is necessary to provide a wire protection element so that the conductor to be connected is not damaged by the terminal screw when the latter is tightened.

From DE-GM 19 65 790 it is known, with such contact elements, to snap a substantially U-shaped wire protection plate onto the barrel of the terminal screw, one end of the wire protection plate being disposed between the screw and the conductor to be connected. In said case, upon tightening of the screw, the wire protection plate is displaced axially with said screw. Given said construction, however, it is necessary for the screw and the wire protection plate to be prefabricated into a subassembly, which is then inserted into a support body of a plug-in connector and has to be locked in said support body by means of an additional contact retention plate.

SUMMARY OF THE INVENTION

The object of the invention is to design a contact element of the type described initially, i.e. the screw-type terminal thereof, in such a way that it is insertable into a support body and retained therein without additional retaining means being required.

Said object is achieved in that the wire protection plate is substantially L-shaped and comprises an angled foot, that the wire protection plate is inserted into the bore in such a way that the foot is situated at the base of the bore, and that the foot is provided with lateral, barb-like mouldings which, upon insertion of the wire protection plate, dig into the wall of the bore.

Advantageous refinements of the invention are indicated in claims 2 to 4.

The advantages achieved by the invention are, in particular, that a contact element which is simple and inexpensive to manufacture has been created by virtue of designing the wire protection plate and its retention device in accordance with the invention. Said contact element is insertable without difficulty into a location chamber of the support body and no separate contact retention plate is required for its retention.

A further advantage is provided, given a wire protection plate having a reinforced limb and a rounded transition between the foot and the limb, in that the reinforced region is not deformed during tightening of the terminal screw and the resilient properties of the rounded transition remain unaffected. As a result, the wire protection plate presents optimum elastic and elastic recovery properties.

A further advantage is provided, given the fashioning of the conductor insertion bore with a tulip-shaped insertion region and a correspondingly adapted limb of the wire protection plate and the use of a terminal screw with a spherical tip, in that the distance between the point of introduction of force and the point of support of the wire protection plate against the conductor/stranded conductor is considerably reduced compared to conventional constructions. The resultant effect is that, given an identical tightening torque of the screw, the flexural stress of the component is virtually halved, with the result that the return deformation is increased and the service life prolonged.

BRIEF DESCRIPTION OF THE DRAWINGS

An embodiment of the invention is illustrated in the drawings and described in detail below. The drawings show.

DESCRIPTION OF THE PREFERRED EMBODIMENTS

Figure 1:
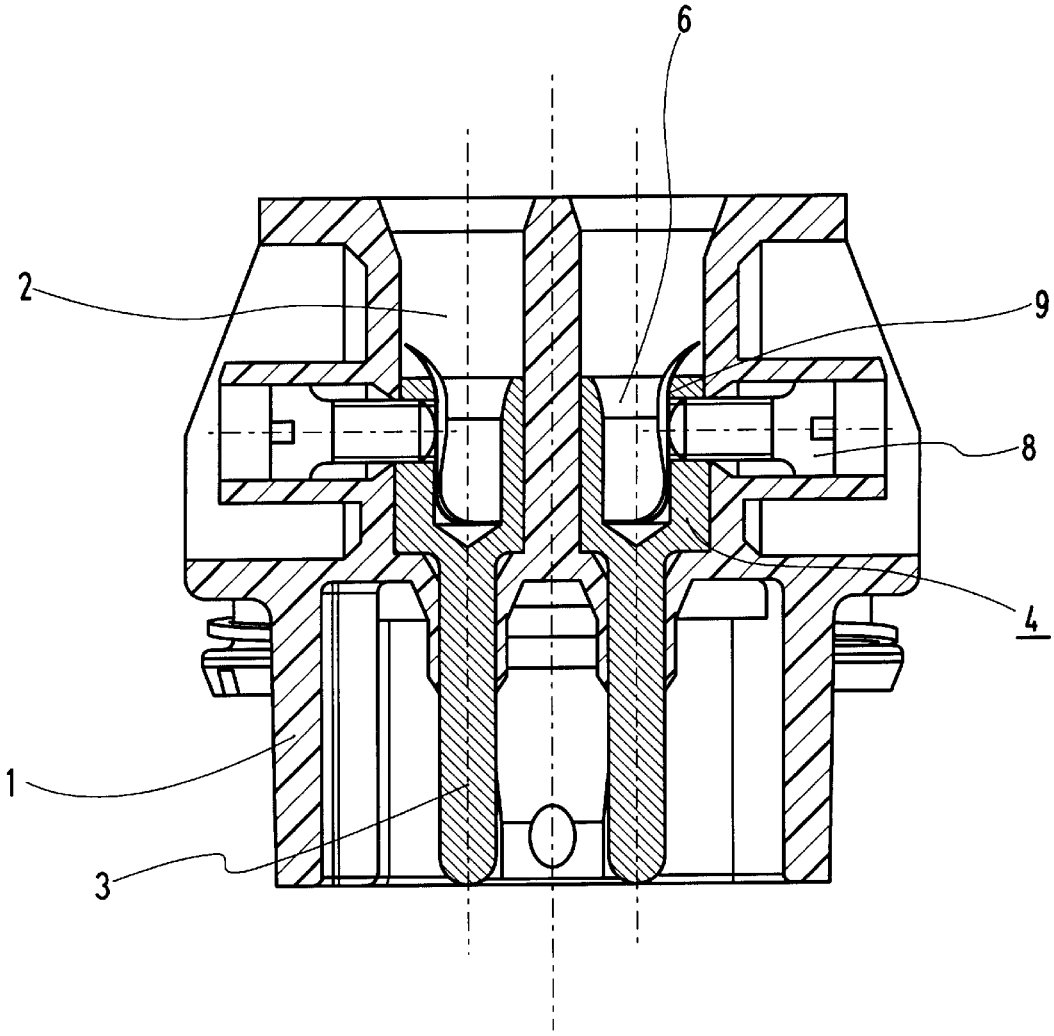
FIG. 1 a sectional view of a support body with inserted contact elements.

FIG. 1 shows a sectional view of a support body 1 made of insulating material for an electrical plug-in connector. The support body is provided with chambers 2, into which electrical contact elements 3 are inserted. In said case, the contact elements are retained with positive engagement in the chambers.

The contact elements are provided with a screw-type terminal 4 for connecting and fastening electric conductors 5.

Figure 2:
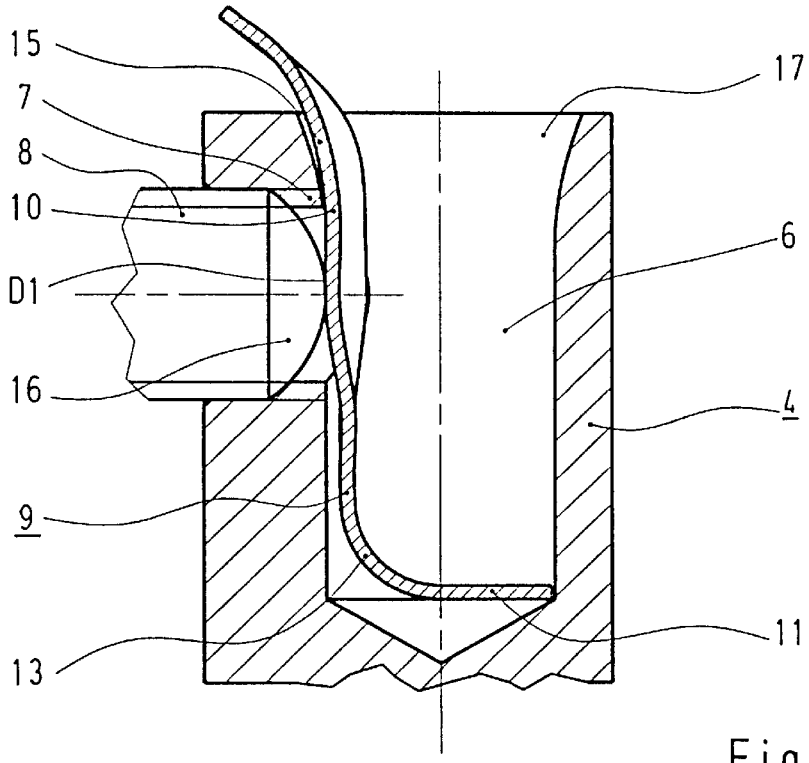
FIG. 2 a sectional view of a conductor connection part of the contact element, FIG. 3 the sectional view of the conductor connection part according to FIG. 2 with an inserted conductor, FIG. 4 a perspective view of the wire protection plate, FIG. 5 a plan view of the screw-type terminal of a contact element, and FIG. 6 a perspective sectional view of the contact element.
Figure 3:
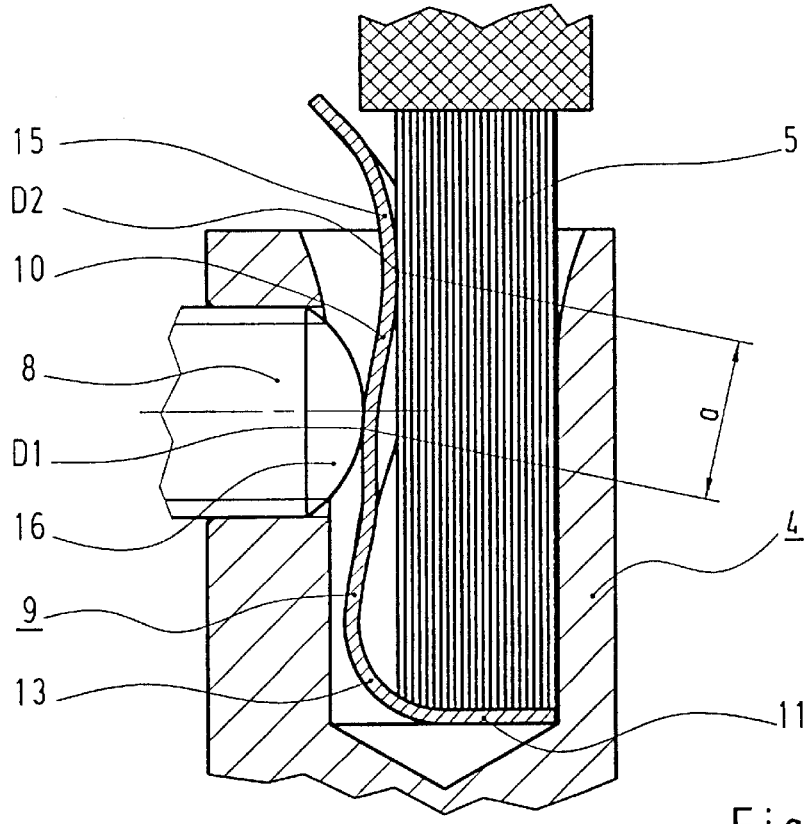

In FIGS. 2 and 3, the screw-type terminal 4 of a contact element is shown in a cutout and enlarged manner.

In the present case, the contact element for forming the screw-type terminal is provided with an axial bore 6 in the form of a blind hole. There is further provided, extending at right angles to said bore, a threaded bore 7 into which a terminal screw 8 is inserted.

Inserted into the bore 6 is a substantially L-shaped wire protection plate 9, the limb 10 of which is situated, after the insertion of a conductor 5 into the bore, between the front end of the screw 8 and the conductor 5.

Figure 4:
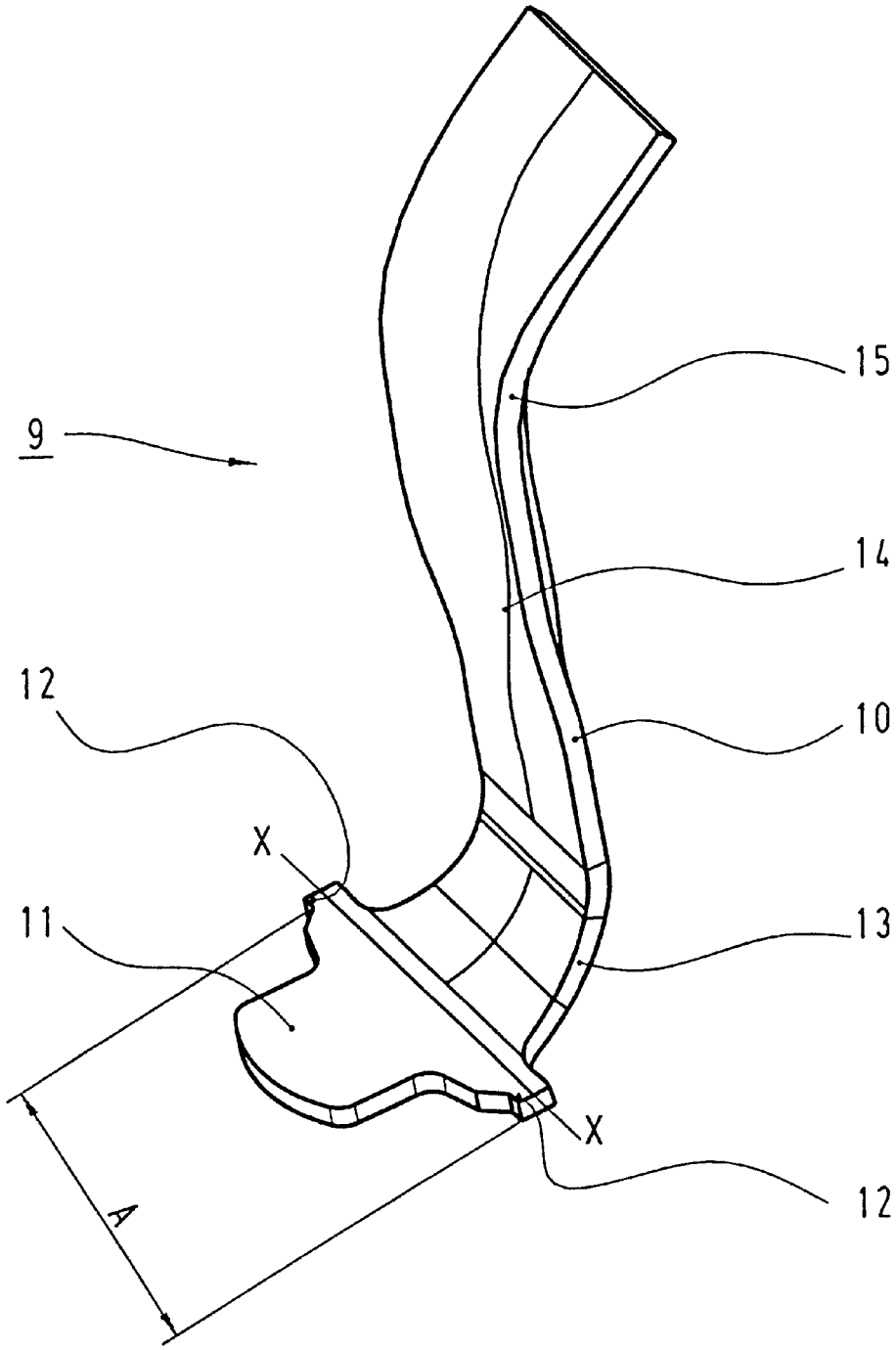
Figure 5:
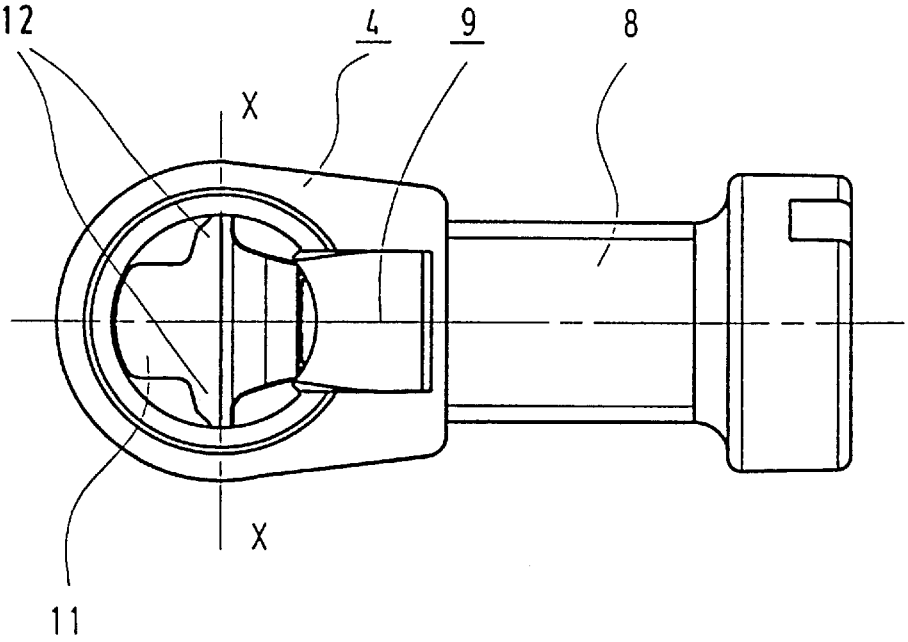
Figure 6:
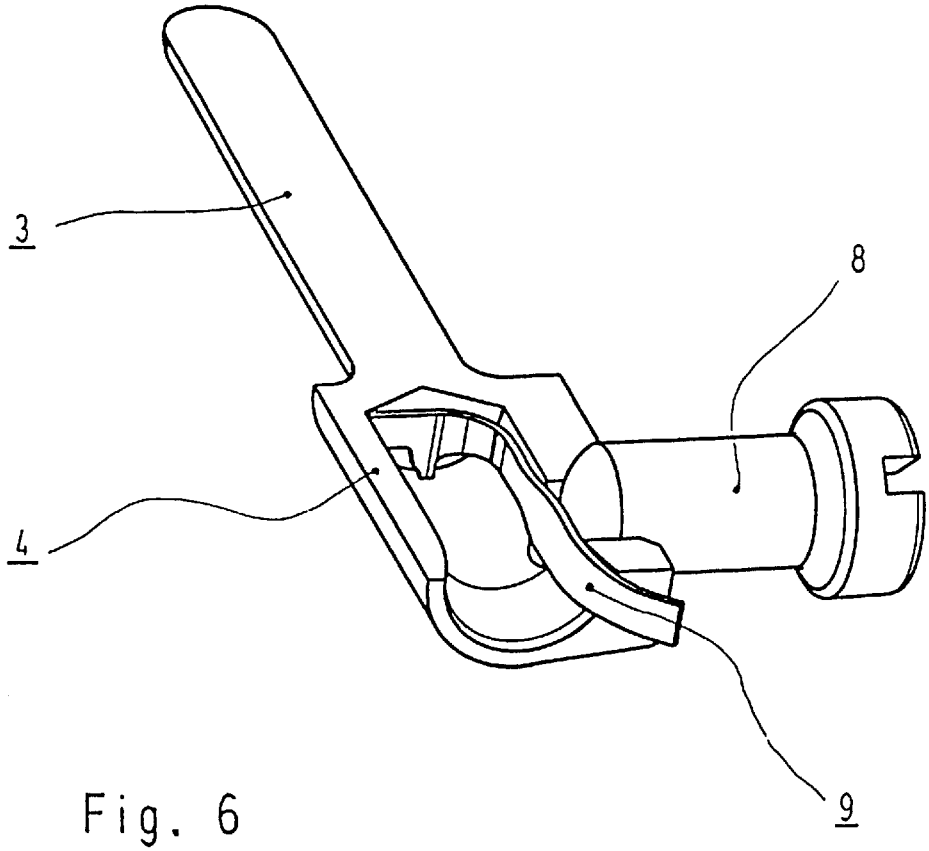

The wire protection plate 9, a perspective enlarged view of which is shown in FIG. 4, comprises an angled foot 11 and the limb 10 already mentioned. Formed on the foot are lateral mouldings 12. The outside distance A of said mouldings is slightly greater than the diameter of the bore 6 of the screw-type terminal. The effect thereby achieved is that, when the wire protection plate is pressed into the bore 6, the mouldings dig into the wall of the bore and the wire protection plate is held captive therein (see FIGS. 5 and 6).

Said securing of the wire protection plate by means of the mouldings moreover acts in the manner of a pivot bearing and the wire protection plate may swivel to a slight extent about the axis X.

The transition 13 from the foot 11 to the limb 10 of the wire protection plate is preferably rounded in order to achieve a resilience of the wire protection plate in said region. The limb 10 of the wire protection plate is moreover provided with an embossed portion 14 having an outward curvature which, after mounting of the wire protection plate, is situated in the region of the screw 8. By virtue of said embossed portion, the limb as such is stiff and inflexible and the resilience and deflexion of the wire protection plate upon clamping of a conductor occurs in the transition 13.

The upper end 15 of the limb 10 is moreover bent outwards to a slight extent and the tip 16 of the screw 8 is hemispherical. Viewed as a whole, the limb is therefore slightly S-shaped. The insertion region 17 of the bore 6 is in said case preferably flared in a tulip-like manner. The effect achieved by said measures is that the pressure point D1 of the screw 8 upon the limb 10 and the pressure point D2 of the limb upon the conductor are always a distance apart in every tightening position of the screw, i.e. the pressure point D2 lies in the front region of the bore 6. The result is a high clamping force upon the conductor and a reduction in the flexural stress of the wire protection plate. With regard to the retention of the contact elements in the support body, it is additionally mentioned that the contact elements are inserted with positive engagement into the chambers of the support body and prevented from sliding out of the contact chambers by means of the screws of the screw-type terminals extending through lateral openings of the support body.

What is claimed is:

1. A contact element with a screw-type terminal for electric conductors, wherein the contact element comprises a conductor connection part provided with a bore, into which the conductor is insertable and clampable by means of a screw insertable at right angles to the bore and/or conductor into a threaded bore in the conductor connection part, and wherein between the end of the screw directed towards the conductor and the conductor a wire protection plate is provided in the bore, characterized in that the wire protection plate (9) is substantially L-shaped and comprises an angled foot (11), that the wire protection plate (9) is inserted into the bore (6) in such a way that the foot (11) is situated at the base of the bore, and that the foot (11) is provided with lateral, barb-like mouldings (12) which, upon insertion of the wire protection plate (9), dig into the wall of the bore (6), wherein the insertion region (17) of the bore (6) is flared in a tulip-like manner, and the upper end (15) of the limb (10) of the wire protection plate (9) is provided with a correspondingly shaped, outwardly directed curvature which lies on the flared insertion region.

2. Contact element according to claim 1, characterized in that the limb (10) of the wire protection plate (9) adjoining the foot (11) comprises an embossed reinforcing bead (14), and that the transition (13) from the foot (11) to the limb (10) is rounded.

3. Contact element according to claim 1, characterized in that the front end of the screw (8) is provided with a hemispherical tip (16).

* * * * *